United States Patent [19]

Wadstein

[11] 4,357,869

[45] Nov. 9, 1982

[54] DEVICE FOR STRETCHING AND FIXING A CLOTH ON A FRAME

[76] Inventor: Gösta Wadstein, Von Holtens Väg 1, Lerum, Sweden, 443 00

[21] Appl. No.: 177,752

[22] PCT Filed: Apr. 12, 1970

[86] PCT No.: PCT/SE79/00090

§371 Date: Dec. 18, 1979

§102(e) Date: Dec. 10, 1979

[87] PCT Pub. No.: W079/00939

PCT Pub. Date: Nov. 15, 1979

[30] Foreign Application Priority Data

Apr. 18, 1978 [SE] Sweden ..... 7804347
Apr. 18, 1979 [IT] Italy ..... 48771 A/79

[51] Int. Cl.[3] ..... B05C 17/06
[52] U.S. Cl. ..... 101/127.1; 69/19.3
[58] Field of Search ..... 101/127.1, 126, 128.1; 69/19.3; 254/22

[56] References Cited

U.S. PATENT DOCUMENTS 1,778,385 10/1930 Griess ..... 101/126
3,391,635 7/1968 Mathews ..... 101/127.1
3,608,482 9/1971 Buhley ..... 101/127.1
3,608,484 9/1971 Buhley ..... 101/127.1
3,608,517 9/1971 Shroff ..... 101/127.1

FOREIGN PATENT DOCUMENTS 892582 10/1953 Fed. Rep. of Germany ... 101/127.1
1083218 6/1960 Fed. Rep. of Germany .
2020958 11/1971 Fed. Rep. of Germany ... 101/127.1
1802686 3/1978 Fed. Rep. of Germany ... 101/127.1
208446 5/1952 Switzerland .
402790 5/1966 Switzerland .

*Primary Examiner*—Billy S. Taylor
*Attorney, Agent, or Firm*—Holman & Stern

[57] ABSTRACT

The invention refers to a device for stretching and fixing a cloth on a frame and comprises a stand with a rectangular border, a bottom and an underframe. On the bottom an inflatible pad is arranged, against which a pressure plate rests. The pressure plate is somewhat smaller than the border of the stand and is moveable in relation to that and adjustable into different angles relative to the bottom. A clamping device can be placed above the border and is by tightening means pressed against the stand, thereby clamping the cloth against the border.

3 Claims, 3 Drawing Figures

FIG. 1
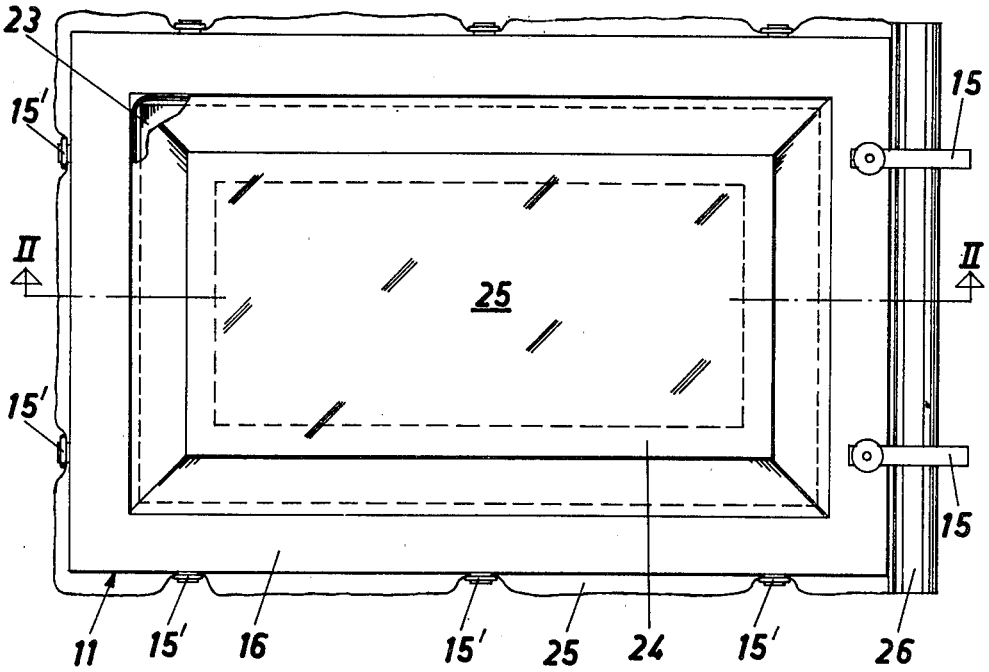
FIG. 2
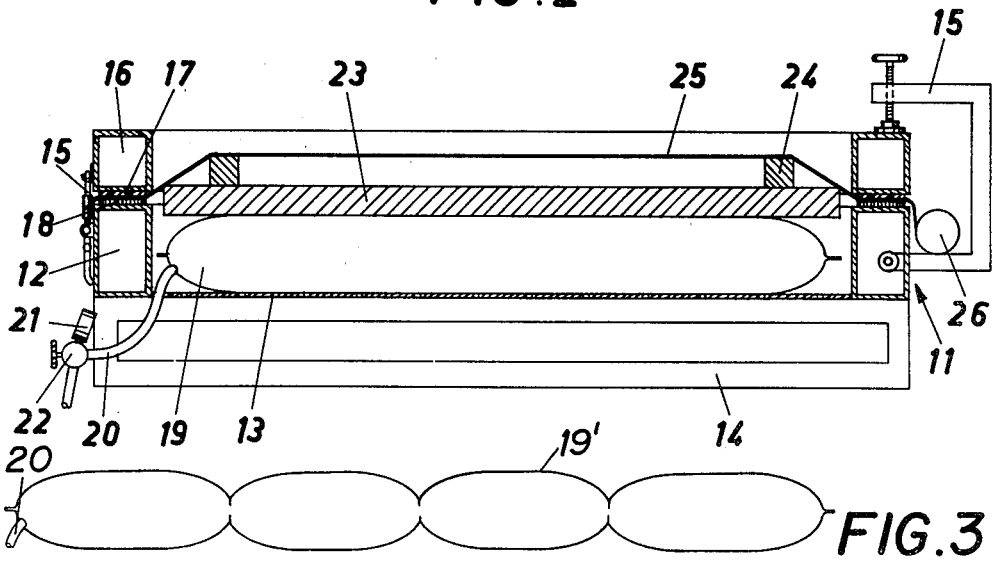
FIG. 3

DEVICE FOR STRETCHING AND FIXING A CLOTH ON A FRAME

BACKGROUND OF THE INVENTION

The present invention refers to a device for stretching and fixing a cloth such as a screen-, strainer-, bolting-, filter cloth or similar material on a frame of the kind comprising a frame-shaped stand, a pressure plate movable in the border of the stand and extending over an essential part of said border and at least one member acting upon the pressure plate for displacing the pressure plate towards the cloth.

When mounting cloths of the above mentioned kind it is important that the cloth is stretched regularly over the whole surface area. For small frames the stretching and fixing have been made manually and inevitable irregularities following such a manual operation had to be tolerated. For large frames including several square meters pneumatic frame stretching devices have been used, which by means of a great number of pneumatic stretching means stretches the cloth until the sufficient stretching force is obtained. With these machines a good result is obtained, but the fixing of a great number of stretching means is difficult and very time-requiring. Moreover such machines are very expensive and require a large space. An example of such a device is described in the Swiss patent specification No. 402.790.

In the German Auslegeschrift No. 2.020.958 is described a device of the kind mentioned above, which however has certain drawbacks. Thus the pressure plate can be displaced only perpendicular to the guides in the frame. By reason of that the pressure plate cannot compensate possible irregularities of the stretching of the cloth against the frame.

In the U.S. Pat. No. 1,778,385 a device for stretching a skin against a stencil is described, at which pneumatic pads are used. The purpose is to make the stencil lie tightly against the skin, thus preventing the dye or other colouring material used from running underneath the stencil. This device is accordingly intended for a quite different purpose and for a different technical field than the device according to the invention.

BRIEF SUMMARY OF THE INVENTION

The purpose of the present invention is to provide a device, which facilitates the procedure of stretching and fixing the cloth and which by simple means and at a reasonable price gives a perfect result. It is an important condition that the pressure plate can be adapted also to irregularly mounted cloths.

This has according to the invention been achieved by the fact that the frame-shaped stand is provided with a bottom, that said member comprises at least one pad inflatable with a fluid and arranged between the bottom of the stand and the pressure plate, which is so much smaller than the border of the stand that the pressure plate is adjustable in different angles in relation to the bottom and that on the upper edge of the border of the stand a clamping device is attachable for clamping the cloth on all sides against the border, said clamping device comprising a frame, which by means of tightening means can be pressed against the stand.

DESCRIPTION OF THE DRAWINGS

The invention will now be further described with reference to an embodiment shown in the accompanying drawing.

FIG. 1 is a top plan view of the device according to the invention,

FIG. 2 is a cross section taken along line II - II in FIG. 1, and FIG. 3 is a cross-sectional view of another embodiment of the pneumatic pad employed in the invention.

DETAILED DESCRIPTION

The stretching and fixing device according to the invention comprises a box-shaped stand 11 comprising a rectangular border 12, a perforated bottom plate 13 and an underframe 14. A clamping device 16 can by clamps of tightening means 15, 15' be pressed against the upper edge of the border 12, which is made of square tubes.

The clamping device 16 comprises a frame of substantially the same size as the border 12, said frame also being made of square tubes. At the pressure surfaces between the clampimg device 16 and the border 12 facing and cooperating with each other a friction lining 17 and an elastic pressure lining 18 respectively, or vice versa, are attached.

On the perforated bottom 13 of the stand 11 an expandable member 19 is placed, which according to the embodiment shown comprises a pneumatic pad of a plastic or rubber material. The inflation of the member 19 and the discharge of air can be made by way of a flexible tube 20 connected thereto and with a pressure gauge 21 and a stop valve 22. A pressure plate 23 rests against the pad 19, said pressure plate extending over a substantial part of the free space between the side edges of the border 12.

The cloth is stretched and fixed in the following way. A frame 24 over which a cloth 25 is to be stretched is placed substantially in the middle of the pressure plate 23 and the cloth 25 is uncoiled from a supply roller 26 and is widened spread over the frame 24 and over the edges of the border 12. At this initial working moment the clamping device 16 has been removed and the air has been evacuated from the pad 19. After having placed the cloth over the frame 24 and the border 12 of the stand the clamping device is placed on the cloth 25 just opposite the upper edge of the border and the tightening clamps 15 are tightened, so that the clamping device 16 is pressed against the border and an effective fixing of the cloth 25 is achieved. Then the pad 19 is inflated to an appropriate pressure, which can be read on the pressure gauge 21. When the pad 19 is expanded the pressure plate 23 with the frame 24 will be pressed against the fixed cloth 25 and if this is irregularly fixed the pad will compensate for such irregularities, so that an absolute regular stretching is achieved.

At very large stretching and fixing devices several pneumatic pads could be used, or the pad could be divided into a number of sections communicating with each other as shown at 19' in FIG. 3.

The invention is not limited to the embodiment described above and shown in the drawing, but a number of variations are possible within the scope of the claims. Thus the tightening clamps 15 of the clamping device 16 can be of another type, e.g. pneumatically or hydraulically operated.

I claim:

1. A device for stretching and fixing a cloth such as a screen, strainer, bolting, filter cloth or the like on a frame comprising a frame-shaped stand having a border defining a free space therewithin, a clamping edge on said border, a pressure plate movable within the border of the stand and extending over a substantial part of the free space within said border and at least one member acting upon the pressure plate for displacing the pressure plate with respect to the stand, said frame-shaped stand being provided with a bottom, said member comprising at least one resilient expandable pad inflatable with a fluid and arranged between said bottom of the stand and the pressure plate, the pressure plate having outer peripheral dimensions a predetermined amount smaller than the outer peripheral dimensions of said free space so that the pressure plate is self-adjustable in different angles in relation to said bottom, and a clamping device removably attachable to said stand for clamping the cloth on all sides against the clamping edge of said border, comprising a clamping frame and clamping means for tightening said clamping frame against said clamping edge.

2. A device according to claim 1, and further comprising a friction lining and an elastic pressure lining disposed at the clamping interface between said clamping frame and clamping edge so that the cloth passes between said linings to be held thereby in use.

3. A device according to claim 1 or 2, wherein said expandable pad is inflated pneumatically and is made of a plastic material, said pad being divided into a number of compartments communicating with each other.

* * * * *

UNITED STATES PATENT AND TRADEMARK OFFICE

CERTIFICATE OF CORRECTION

PATENT NO. : 4,357,869
DATED : November 9, 1982

INVENTOR(S) : Gösta Wadstein

It is certified that error appears in the above-identified patent and that said Letters Patent are hereby corrected as shown below:

On the title page
" [22] PCT Filed: Apr. 12, 1970"

Should be
-- [22] PCT Filed: Apr. 12, 1979 --

Signed and Sealed this

*Thirty-first* Day of *May 1983*

[SEAL]

*Attest:*

DONALD J. QUIGG

*Attesting Officer* *Acting Commissioner of Patents and Trademarks*